US006585255B2

(12) United States Patent
Evansic

(10) Patent No.: US 6,585,255 B2
(45) Date of Patent: Jul. 1, 2003

(54) VIBRATORY SHEET JOGGERS

(75) Inventor: Leonard Evansic, Graceton, PA (US)

(73) Assignee: FMC Technologies, Inc., Chicago, IL (US)

( * ) Notice: Subject to any disclaimer, the term of this patent is extended or adjusted under 35 U.S.C. 154(b) by 76 days.

(21) Appl. No.: 09/785,067

(22) Filed: Feb. 15, 2001

(65) Prior Publication Data

US 2002/0109287 A1 Aug. 15, 2002

(51) Int. Cl.[7] ..... B65H 31/38
(52) U.S. Cl. ..... 271/146; 271/210; 414/788
(58) Field of Search ..... 271/221, 222, 271/180, 181, 210, 226, 146; 198/750.1, 752.1, 769; 414/415, 789.1, 788

(56) References Cited

U.S. PATENT DOCUMENTS 3,545,741 A * 12/1970 Porth ..... 271/146 X
3,587,853 A * 6/1971 Barnes ..... 217/146 X
3,862,752 A * 1/1975 Totten ..... 271/221 X
4,674,732 A * 6/1987 Hori ..... 271/221 X

OTHER PUBLICATIONS

FMC Syntron® Vibrating Paper Joggers Brochure (20 pages), 2000.
FMC Syntron® DL–1–A Dental Vibrator Brochure (8 pages).
FMC Syntron® Vibrating Paper Joggers Brochure (4 pages) 1993.
FMC Syntron® J–50–B Jogger Brochure (12 pages).
FMC Service Instructions Syntron® Jogger Model TJ–2–B (4 pages).
FMC Service Instructions Syntron® Jogger Model: J–1–B (16 pages).
FMC Syntron® WhisperDek™ Jogger Technical Data and Advertisement (2 pages ) 1998.
FMC Syntron® Model J–1 Single Bin Vibrating Paper Jogger Brochure (2 pages).
FMC Syntron® PowerPulse™ (115V) RC Control Manual (4 pages).

* cited by examiner

*Primary Examiner*—Janice L. Krizek
(74) *Attorney, Agent, or Firm*—Wood, Phillips, Katz, Clark & Mortimer

(57) ABSTRACT

A sheet jogging device includes a compact housing having an inclined front face, and a rack resiliently mounted to said housing along said front face. Within the housing a drive spring is fixed at one end to the housing and connected at an opposite end to the rack. An electromagnet is mounted beneath the drive spring to exert an oscillating magnetic force on the drive spring to flex the drive spring about its base to reciprocate the rack along the inclined face of the housing.

10 Claims, 5 Drawing Sheets

VIBRATORY SHEET JOGGERS

TECHNICAL FIELD OF THE INVENTION

The present invention relates to vibratory sheet joggers which are used to orderly align sheets, such as paper, in a stack.

BACKGROUND OF THE INVENTION

Paper joggers are known for aligning paper and card stock in a vertical or horizontal stack. A number of vibrating paper jogger models are manufactured by FMC Corporation, Material Handling Equipment, of Homer City, Pa. For example, the Syntron® model J-1 Single Bin Vibrating Paper Jogger includes a single bin which is tipped rearwardly and which is configured to align paper sheets and other paper grades in a vertical stack. The single bin is mounted on a base component which contains a vibratory device. The vibratory device includes an electromagnet mounted to the base component and an armature mounted to the bin. A rheostat controls the amplitude of vibration of the bin for the grade and size of stock to be handled. The vibration direction is oriented vertically with a magnetic gap being vertically disposed. The bin and armature connected thereto can be mounted on leaf springs with respect to the base component.

Syntron® J-50 Paper Jogger includes a multiple pocket tilted rack mounted above a base component. The base component includes a base plate which mounts an electromagnet and a plurality of rubber mounts. The rubber mounts extend from the base plate and support a cover component. The cover component has an armature attached thereto which is vibrated by magnetic force from the electromagnet. The cover vibrates via the rubber mounts with respect to the base plate. The rack is mounted directly to the cover component. This device utilizes a vertical line of vibratory force with a vertical adjustable air gap.

Syntron® Jogger model TJ-2 includes a multiple pocket, tilt rack mounted on a base component. The base component includes a slightly tilted, substantially horizontally arranged line of vibratory force having a slightly tilted, substantially horizontal air gap. The rack is mounted to the base component via rubber mounts. The vibrational amplitude can be adjusted by turning a rheostat knob on the front of the base component.

Although these models produce effective paper and sheet jogging results, the present inventors have recognized the desirability of providing a sheet or paper jogging device that has a small overall size, that is easily and quickly operated, that is aesthetically pleasing in overall appearance, and that comprises a simple, low cost design.

SUMMARY OF THE INVENTION

The present invention provides an improved jogging device for aligning sheets, such as sheets of paper or envelopes, that is particularly suited for smaller stacks of sheets, than the prior known jogging devices. The jogging device of the present invention provides a layout that accommodates a compact housing. The jogging device requires a reduced desk or table space for operation. The vibrational driver of the jogging device of the invention can be fashioned to have low power consumption and low noise production. The arrangement of the jogging device requires no amplitude adjustment, is self cleaning, and has low maintenance requirements. The jogging device can be economically produced at a low cost.

The exemplary embodiment of a jogging device according to the invention includes a housing having a base plate providing a support surface for electronic components, and a frame mounted to the base plate and having appurtenances or plates for mounting components. A rack for holding a stack of sheets is mounted to the frame via shear spring members. The frame includes a front face tilted rearwardly in an upward direction from the base plate wherein the rack is mounted over the front face and assumes a similar tilting angle.

A drive spring comprises an elongated spring plate of a material, such as steel, that is movable by a magnet, fixed at a base end to an appurtenance adjacent a rear of the housing. The spring plate extends obliquely upwardly from the base end toward the rack, the spring plate being approximately perpendicular to the inclination of the rack. An electromagnet is positioned below the spring plate and has a magnetic direction approximately perpendicular to the spring plate, with a pole of the electromagnet positioned close to the spring plate.

A plate-like manual activation lever extends forwardly of the base plate, beneath the rack for easy, mistake free activation and de-activation of the jogging device. When device electronics are activated by the manual activation lever, the electromagnet is driven in oscillating fashion, i.e., on-off fashion repeatedly with a pulsating direct current. The drive spring is oscillated by magnetic force in cantilever bending fashion about its base end to reciprocate the rack along a direction which follows the inclination of the front face of the frame. Sheets of paper, envelopes, or other materials which are placed vertically in the rack at the rearward tilting angle, are vibrated to be aligned along bottom and rear edges thereof, within the rack.

A cover is closely fitted around the frame, down to the base plate, and provides an aesthetically pleasing overall appearance to the jogging device. Because of the angular arrangement of the electromagnet and the drive spring the rear face of the frame and cover can be angled downwardly in a rearward direction, providing an aesthetically pleasing wedge-shaped appearance and achieving an overall compact design, requiring a reduced desk or table space.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
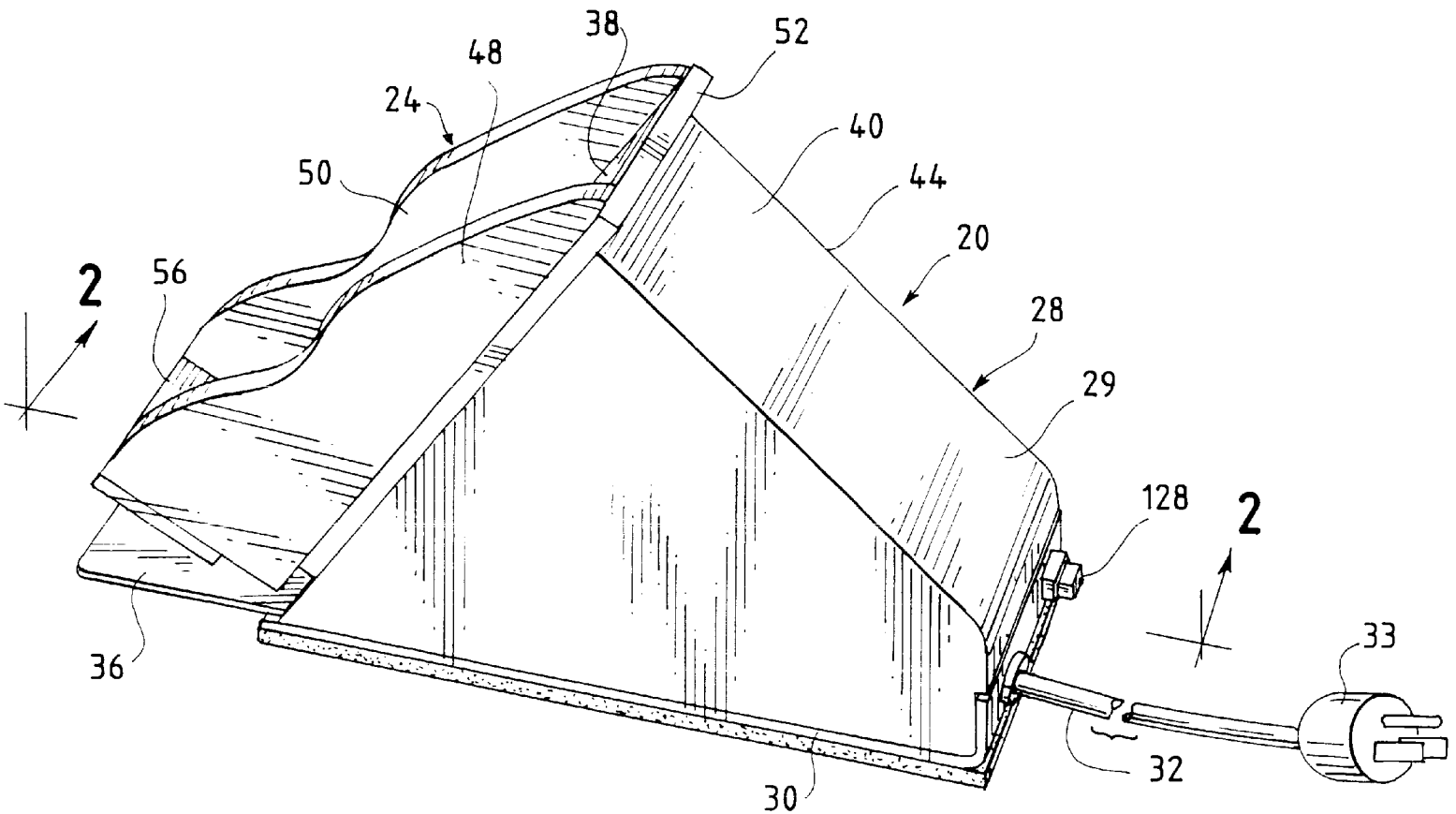
FIG. 1 is a perspective view of a sheet jogging device of the present invention, including a rack, a cover and a base plate.

While this invention is susceptible of embodiment in many different forms, there are shown in the drawings, and will be described herein in detail, a specific embodiment thereof with the understanding that the present disclosure is to be considered as an exemplification of the principles of the invention and is not intended to limit the invention to the specific embodiment illustrated.

FIG. 1 illustrates a jogging device 20 of the present invention. The jogging device is advantageously compact having a length L of about 10–11", a height H of about 7" (see FIG. 2), and a width (into the page of FIG. 2) of about 3". The device weighs about 9–10 pounds. The jogging device 20 includes a sheet receiving rack 24 mounted to a housing 28. The housing includes an outer skin or cover 29 and a base plate 30. The device 20 is supplied with electrical power through a cord 32 via a molded, grounded plug 33. The device 20 includes a cycle on/off activation lever 36.

Viewing from front to back, the housing 28 includes a rearwardly inclined tilted front face 38, and a rearwardly declined rear face 40. The housing 28 includes substantially vertical side walls 42, 44.

The rack 24 includes contoured sidewalls 48, 50 which are attached to a back plate 52. The sidewalls 48, 50 can be composed of wood such as mahogany or maple, for operational quietness and aesthetics. The back plate 52 is mounted to be substantially parallel to the front face 38 of the housing 28. The rack 24 further includes a bottom plate 56 connected between the sidewalls 48, 50 which serves to support a stack of sheets placed within the rack, between the sidewalls 48, 50. The bottom plate 56 is spaced from the back plate 52 so that the rack is effectively self-cleaning, i.e., any debris on the rack will pass through a gap 57 between the back plate 52 and the bottom plate 56.

The rack inside surfaces, including the back plate, can be covered in a contoured neoprene surface for quiet operation. Such a surface treatment is marketed as FMC Corporation's WISPERDEK technology.

Figure 2:
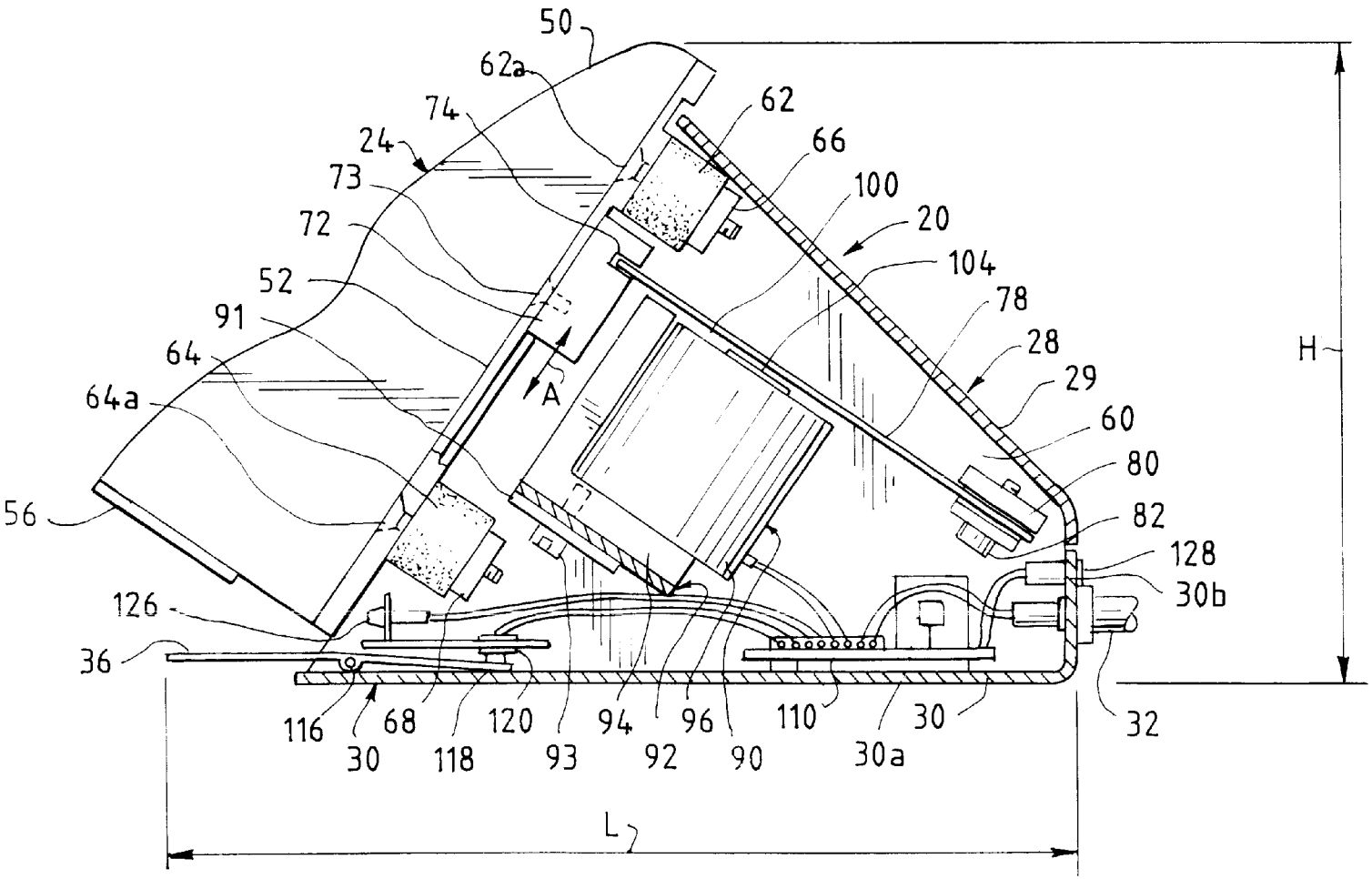
FIG. 2 is a sectional view taken generally along lines 2—2 of FIG. 1.

FIG. 2 illustrates the internal components of the device 20. The housing 28 includes a frame or main body member 60 beneath the cover 29. The frame can comprise a metal unitized weldment or casting. The frame includes sidewalls 60*a*, 60*b* (shown in FIG. 3A). The back plate 52 of the rack 24 is mounted to the frame 60 via elastomeric spring members 62, 64, such as rubber spring members, connected to spring mounting plates or appurtenances 66, 68, respectively by fasteners 62*a*, 64*a*. The spring mounting plates 66, 68 are formed with the frame 60 or attached thereto. On a back side of the back plate 52 is mounted a drive block 72 having a lateral slot 74. The drive block is preferably composed of plastic. A drive spring 78 is fastened at a base end to a drive spring mounting bar or appurtenance 80 via fasteners 82. The drive spring mounting bar 80 is formed with, or connected to, the frame 60.

An electromagnet assembly 90 is located beneath the drive spring 78. The assembly 90 is mounted to a support plate or appurtenance 91 via a spacer 92 and a fastener 93. The appurtenance 91 is either connected to, or formed with, the frame 60. The electromagnet assembly 90 includes a substantially U-shaped core 94 and a coil 96 surrounding one leg of the U-shaped core 94. An electromagnetic gap 100 is formed between the ends of the core 94. An air gap 104 is formed between the core 94 and the drive spring 78. By imposing a pulsating direct current through the coil 96, the drive spring 78 is oscillated by being drawn toward the electromagnet by magnetic attraction to the electromagnet core 94 and then released, oscillating at a drive frequency. The cantilever oscillation of the drive spring 78 about its base end, pivots its distal end and translates the drive block 72 to oscillate the rack 24 along the direction A. The drive spring 78 comprises a material which can be influenced by a magnet, such as steel, which is effectively covered by elastomeric material, such as rubber.

Figure 6:
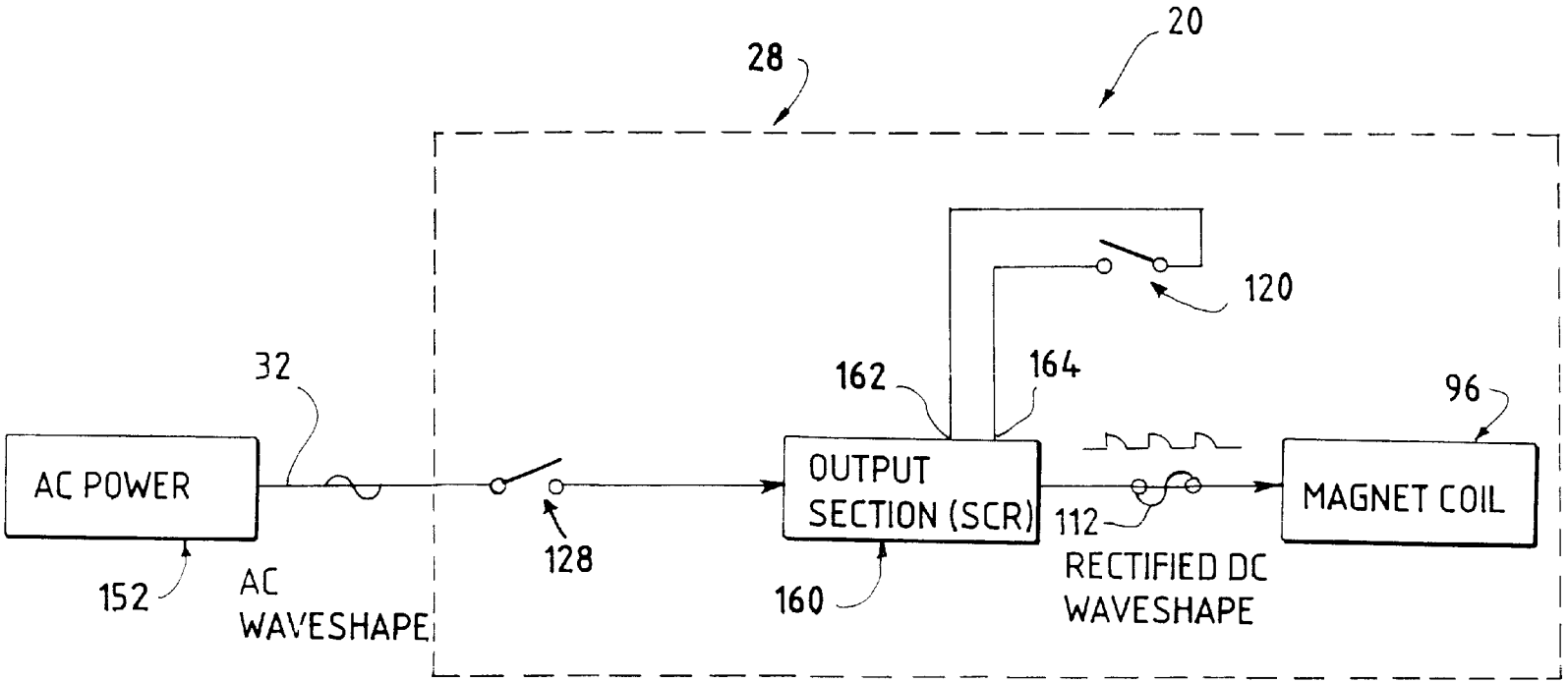
FIG. 6 is a schematic block diagram of the jogging device of the invention.

Power from the cord 32 is directed via an inline switch 128 to a printed circuit board 110. The coil 90 is also wired to the printed circuit board. The activation lever 36 is pivoted about a point 116 to the frame 60. A downward push on the activation lever 36 raises its opposite end 118 to trigger an on/off switch 120, which is wired also to the printed circuit board 110 as shown in FIG. 6. An on/off lamp 126 is also wired to the printed circuit board 110. A coil fuse 112 is mounted to the circuit board and wired as shown in FIG. 6.

The operator is protected from electric shock by the totally enclosed design of the device 20.

Figure 3A:
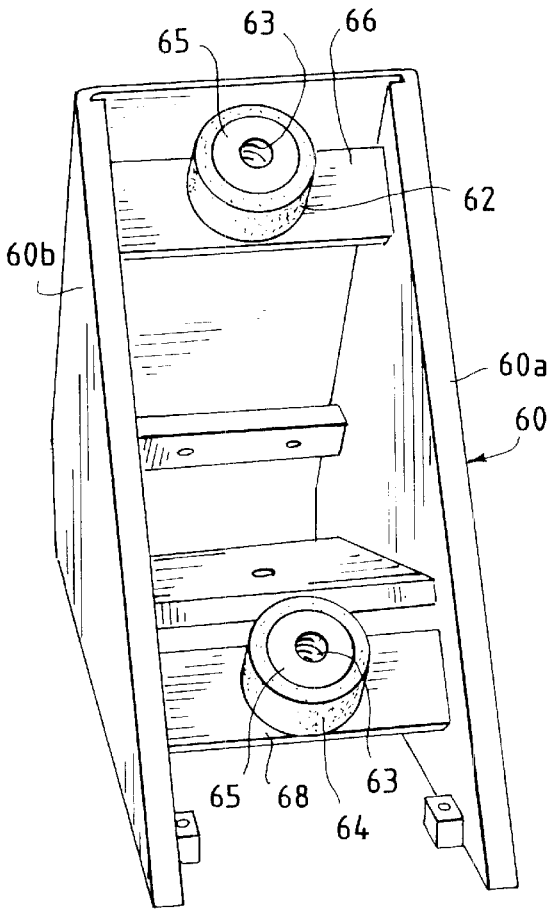
FIG. 3A is a front perspective view of a frame of the device of FIG. 1, shown partly disassembled.

FIG. 3A illustrates the frame 60 with the rack 24 removed. The upper and lower springs 62, 64 are illustrated as being cylindrical with a central bore 63 and an overlying washer 65, for receiving the fasteners 62*a*, 64*a*. The springs 62, 64 are elastomeric shear springs, such as rubber shear springs. The elastomer hardness of the springs is chosen depending on the desired operating parameters.

Figure 3B:
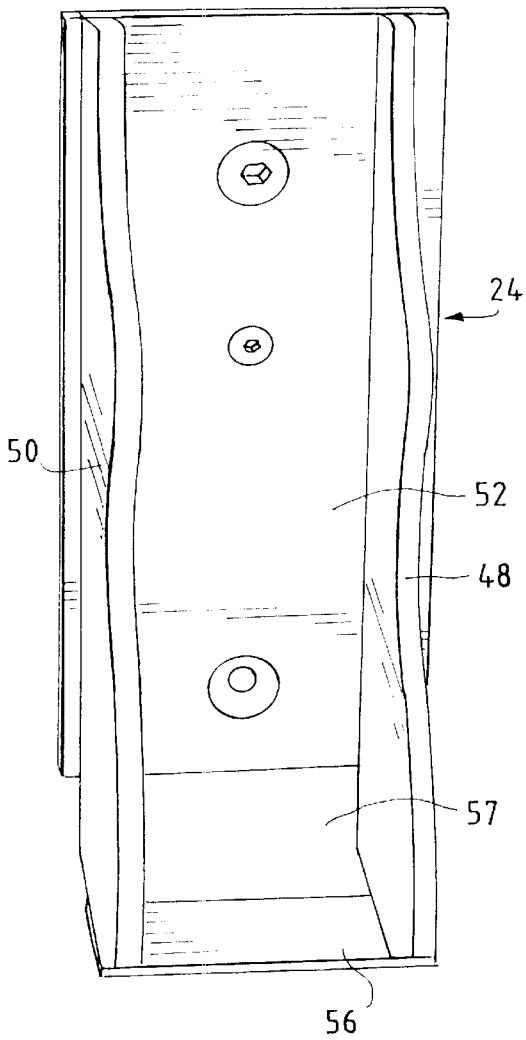
FIG. 3B is a front perspective view of the rack of the device of FIG. 1.

FIG. 3B illustrates a front view of the rack, particularly illustrating the back plate 52, the sidewalls 48, 50 and the bottom plate 56. The self-cleaning gap 57 is also illustrated.

Figure 3C:
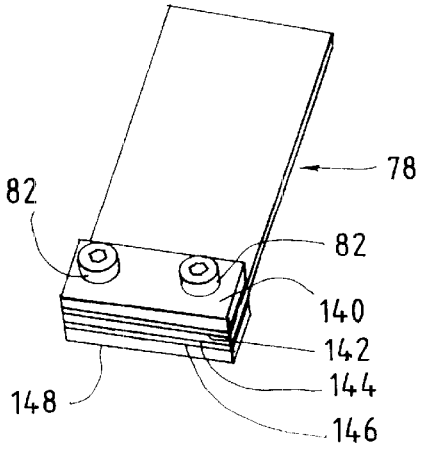
FIG. 3C is a bottom perspective view of a drive spring of the device of FIG. 1.

As shown in FIG. 3C, the drive spring 78 is illustrated in an inverted position, the drive spring having a first clamp plate 140, a first fiber or phenolic spacer 142, a spring plate 144, a second fiber or phenolic spacer 146, and a bottom clamp 148 through which the two fasteners 82 penetrate, to mount the drive spring to the mounting bar 80. The spacers 142, 146 reduce the localized stress on the spring plate 144 caused by vibration thereof during operation by providing some flexibility at the clamped connection to the mounting bar 80. The spring plate 144 is preferably composed of steel encased in rubber or other elastomeric material.

Figure 4:
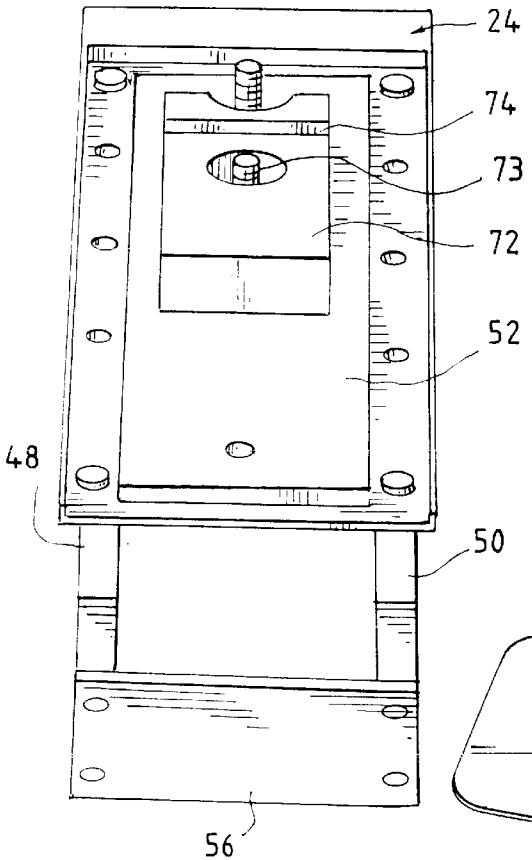
FIG. 4 is a perspective rear view of the rack of the device shown in FIG. 1.

FIG. 4 illustrates the back side of the rack 24, including the drive block 72 with the slot 74 for receiving the distal end of the drive spring 78. An end of the fastener 73 holding the drive block 72 to the back plate 52 is shown.

Figure 5:
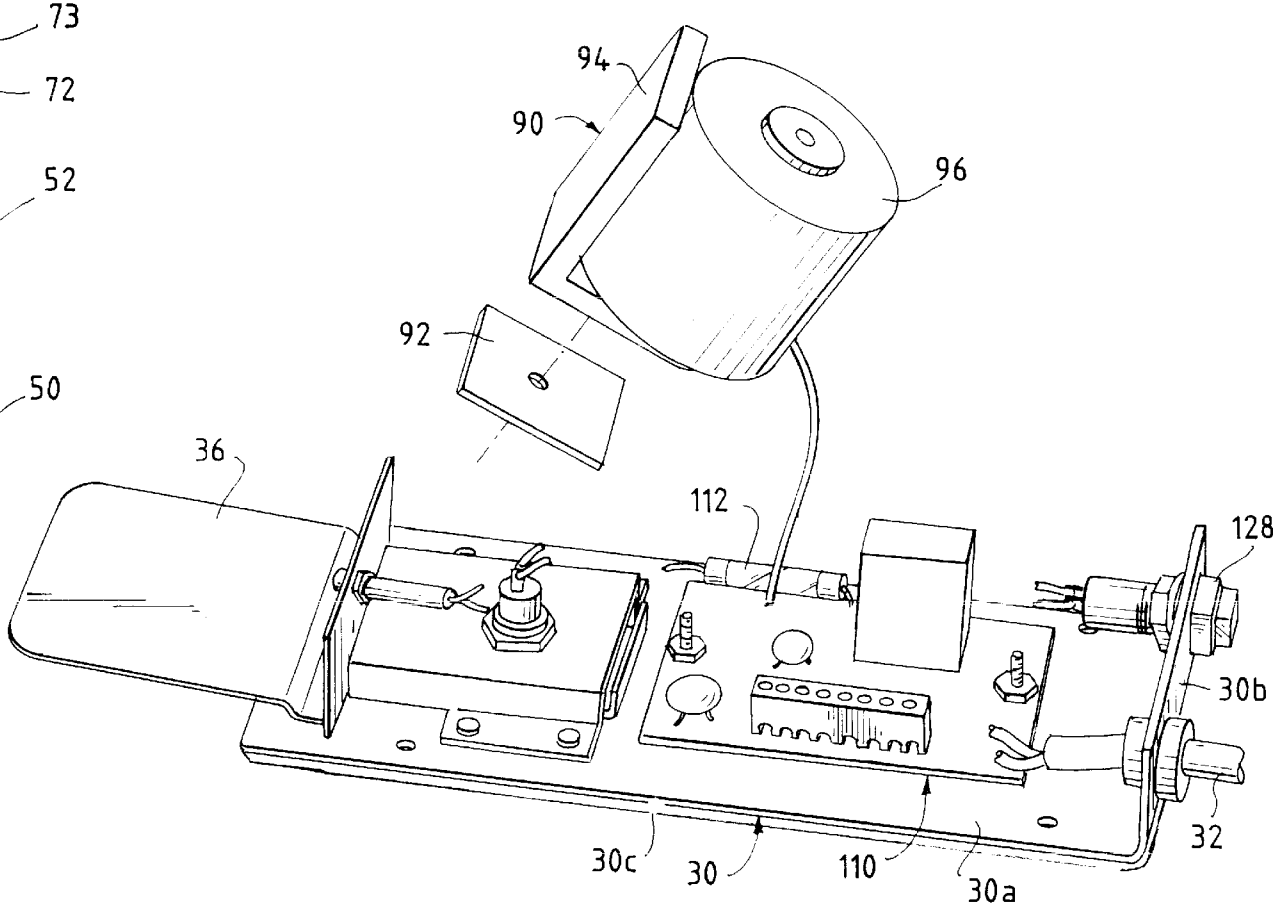
FIG. 5 is an exploded perspective view of the base plate with operating electronics of the device of FIG. 1.

FIG. 5 illustrates the base plate 30 including the printed circuit board 110. The base plate 30 comprises an elongated L-shaped plate having a bottom leg 30*a* bent at a rear thereof into a vertical leg 30*b* through which the cord 32 and the on/off switch 128 pass. The on/off switch and the cord are fixed at penetrations through the vertical leg 30*b*. A highly damped elastomeric layer 30*c* underlies the base plate 30 to isolate vibration from the base plate to the supporting surface, e.g., the table.

The frame and cover are preferably composed of steel, although other suitable materials can be used. The rack can be composed of steel, or wood for quieter operation, or other suitable materials. The rack can also be lined with neoprene for quieter operation.

FIG. 6 illustrates the circuitry of the jogging device 20 in block form. A source of alternating current 152, typically 120 Hz in North America, and 100 Hz in most other countries of Europe or Asia, supplies the device 20 with AC current through the cord 32 and the in line switch 128. Electric current is supplied to output circuitry 160 featuring an silicon controlled rectifier (SCR) circuit. Such circuitry is disclosed for example in U.S. Ser. No. 09/654,475 filed Sep. 1, 2000, and herein incorporated by reference. Additionally, a SCR circuit control is sold under the brand Syntron Power Pulse (115V) RC Control, by FMC Corporation, Material Handling Equipment, of Homer City, Pa., which can be incorporated into the device of the invention.

The preferred embodiment of the invention is advantageously configured to have a non adjustable vibration amplitude for cost savings. Therefore, the potentiometer included in the aforementioned devices can be omitted and replaced with a fixed resistor. The jogging device 20 is preferably operated with an amplitude of about 0.060 inches (taken along the direction A in FIG. 2) for paper sheets, at a frequency of 60 Hz.

The switch 120 can be connected to contacts 162, 164 which are connected to enable or disable the gate circuit to the SCR. This allows the output to the electromagnet to run or to be shut off. The SCR circuit 160 produces a rectified DC waveform to the electromagnet coil 96. The coil fuse 112 shown in FIG. 2 protects the coil 96 from excessive current.

From the foregoing, it will be observed that numerous variations and modifications may be effected, without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A vibratory sheet jogger, comprising:

a housing having a base plate and a pair of sidewalls extending upwardly from said base plate and defining therewith an open front face;

a rack positioned at said open face of said housing;

at least one spring member mounted on a spring mounting plate extending between said sidewalls of said housing, said rack being connected to said spring member for connecting said rack to said housing;

a drive spring having an elongated body being substantially fixed at a base end to said housing by a spring mounting bar extending between said sidewalls thereof, and engaged at a distal end thereof to a drive block on said rack;

an electromagnet mounted on a support plate extending between said sidewalls of said housing and arranged on one side of said drive spring and located to have an air gap between said electromagnet and said drive spring, said air gap small enough for said electromagnet to exert a magnetic force on the drive spring to deflect said drive spring about said base end to move said rack in opposite directions as the magnetic force on said drive spring oscillates.

2. The jogger according to claim 1, wherein said open front face of said housing is angled toward the rear, and said rack comprises a back face substantially parallel to said front face of said housing.

3. The jogger according to claim 1, wherein said jogger comprises a pair of said spring members respectively comprising two elastomeric shear springs each mounted at one end to said housing on a respective spring mounting plate extending between said sidewalls of said housing and connected at an opposite end to said rack, said springs arranged on respective opposite sides of said distal end of said drive spring.

4. The jogger according to claim 1, comprising an activation lever beneath said rack, said lever engaged to an on/off switch within said housing depressing said activation lever changing the operating state of said on/off switch.

5. The jogger according to claim 1, wherein said electromagnet comprises a U-shaped core having free ends adjacent said drive spring, and a coil which is wrapped around one of said legs of said U-shaped core.

6. The jogger according to claim 1, wherein said front face of said housing inclines rearwardly directly from said base plate, and said housing comprises a rear wall which declines rearwardly from said front face.

7. The jogger according to claim 6, wherein said base plate comprises a rear vertical leg which rises to said rear wall.

8. A vibratory sheet jogger comprising:

a housing having a base plate, a pair of sidewalls extending upwardly therefrom and defining therewith, a rearwardly tilting open front face extending up from said base plate;

a rack positioned at said open front face having a rearwardly tilting back plate, said back plate for guiding an edge of a stack of sheets, said back plate being parallel to said front face;

at least one elastomeric spring member mounted on said sidewalls of said housing, said rack being connected to said spring member for connecting said rack to said housing; and an electromagnetic drive mounted on said housing between said sidewalls, and operative to oscillate said rack with respect to said housing, said electromagnetic drive including a cantilevered drive spring having a base end mounted on said housing by a spring mounting bar extending between said sidewalls of said housing, said drive spring extending from said spring mounting bar and having a distal end in engagement with said rack, said electromagnetic drive further including an electromagnet mounted on said housing between said base plate and said cantilevered drive spring.

9. The jogger according to claim 8, wherein said housing comprises a rear wall extending from said front face rearwardly and downwardly at an oblique angle to vertical.

10. The jogger according to claim 9, wherein said base plate comprises an L-shaped member having a relatively long horizontal leg and a relatively short vertical leg arranged at a rear face of said housing.

* * * * *